United States Patent [19]

Sokola et al.

[11] 4,431,977

[45] Feb. 14, 1984

[54] CERAMIC BANDPASS FILTER

[75] Inventors: Raymond L. Sokola, Lake Zurich; Charles Choi, Schaumburg, both of Ill.

[73] Assignee: Motorola, Inc., Schaumburg, Ill.

[21] Appl. No.: 349,346

[22] Filed: Feb. 16, 1982

[51] Int. Cl.[3] ..... H01P 1/202; H01P 1/205; H01P 7/04

[52] U.S. Cl. ..... 333/206; 333/202; 333/207; 333/222

[58] Field of Search ..... 333/202–212, 333/219–236, 13, 245, 248, 134–137, 185; 334/41–45; 343/850, 852, 905

[56] References Cited

U.S. PATENT DOCUMENTS

| | | | |
|---|---|---|---|
| 3,293,644 | 12/1966 | Loos et al. | 333/202 |
| 3,413,577 | 11/1968 | Massano | 333/226 |
| 3,691,487 | 9/1972 | Yoshimoto | 333/202 |
| 3,713,051 | 1/1973 | Kell | 333/202 X |
| 3,728,731 | 4/1973 | Choi et al. . | |
| 3,798,578 | 3/1974 | Konishi et al. | 333/229 |
| 3,811,101 | 5/1974 | Karp | 333/207 |
| 3,938,064 | 2/1976 | O'Bryan, Jr. et al. | 333/204 |
| 3,973,226 | 8/1976 | Affolter et al. | 333/202 |
| 4,101,854 | 7/1978 | Gikow et al. | 333/224 |
| 4,136,320 | 1/1979 | Nishikawa et al. | 333/203 |
| 4,179,673 | 12/1979 | Nishikawa et al. | 333/204 |
| 4,186,359 | 1/1980 | Kaegebein | 333/207 X |
| 4,276,525 | 6/1981 | Nishikawa et al. | 333/206 |
| 4,291,288 | 9/1981 | Young et al. | 333/230 X |
| 4,386,328 | 5/1983 | Masuda et al. | 333/202 |

*Primary Examiner*—Marvin L. Nussbaum
*Attorney, Agent, or Firm*—Rolland R. Hackbart; Edward M. Roney; James W. Gillman

[57] ABSTRACT

A unique ceramic bandpass filter is disclosed that is comprised of a dielectric block having one or more holes extending from its top surface to its bottom surface and further having input and output electrodes each disposed on the dielectric block at a predetermined distance from a corresponding hole. The dielectric material is preferably a ceramic comprised of BaO, $TiO_2$ and $ZrO_2$. If there is only one hole in the dielectric block, the input and output electrodes may be arranged around that hole. If there are two or more holes in the dielectric block, one electrode may be located near the hole at one end and the other electrode may be located near the hole at the opposite end of the dielectric block. The dielectric block is entirely plated with copper or silver with the exception of portions near each hole and the input and output electrodes. Each plated hole is essentially a coaxial resonator. Coupling between adjacent coaxial resonators provided by the plated holes can be adjusted by slots or additional holes located therebetween. Two or more of unique ceramic bandpass filters can be intercoupled to provide a filter with greater selectivity or a multi-band filter for combining and/or frequency sorting two or more signals into/from a composite signal.

48 Claims, 13 Drawing Figures

CERAMIC BANDPASS FILTER

BACKGROUND OF THE INVENTION

The present invention is related generally to radio frequency (RF) signal filters, and more particularly to an improved ceramic bandpass filter that is particularly well adapted for use in radio transmitting and receiving circuitry.

Conventional multi-resonator filters include a plurality of resonators that are typically foreshortened short-circuited quarter-wavelength coaxial or helical transmission lines. The resonators are arranged in a conductive enclosure and may be inductively coupled one to another by apertures in their common walls. Each resonator can be tuned by means of a tuning screw which inserts into a hole extending through the middle of the resonator. Once tuned, the overall response of the filter is determined by the size of the interstage coupling apertures. Since the tuning of the filter can be disturbed by a slight adjustment of the tuning screw, a locknut is required to keep the tuning screw properly positioned at all times. The use of tuning screws not only renders these filters susceptible to becoming detuned, but also creates additional problems including mechanical locking of the tuning screw and arcing between the tuning screw and the resonator structure. Futhermore, such filters tend to be rather bulky and therefore are relatively unattractive for applications where size is an important factor.

SUMMARY OF THE INVENTION

Accordingly, it is an object of the present invention to provide an improved ceramic bandpass filter that is smaller and has fewer parts than prior art filters.

It is another object of the present invention to provide an improved low-loss ceramic bandpass filter that exhibits superior temperature stability.

It is yet another object of the present invention to provide an improved ceramic bandpass filter that can be automatically tuned.

It is a further object of the present invention to provide an improved ceramic bandpass filter that is comprised of a single piece of selectively plated dielectric material.

Briefly described, the ceramic bandpass filter of the present invention is comprised of a dielectric block having one or more holes extending from its top surface to its bottom surface and further having first and second electrodes each disposed on the dielectric block at a predetermined distance from a corresponding hole. If there is only one hole in the dielectric block, the first and second electrodes may be arranged around that hole. If there are two or more holes in the dielectric block, the first electrode may be located near the hole at one end of the dielectric block and the second electrode may be located near the hole at the opposite end of the dielectric block. The dielectric block is also covered or plated entirely with a conductive material with the exception of portions near one end of each hole and near the first and second electrodes.

DETAILED DESCRIPTION OF THE PREFERRED EMBODIMENTS

Figure 1:
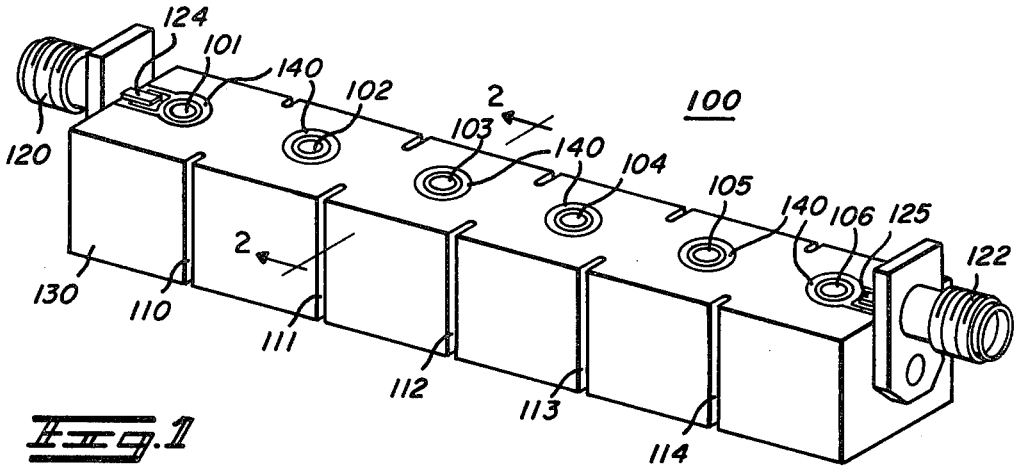
FIG. 1 is a perspective view of a ceramic bandpass filter embodying the present invention.

In FIG. 1, there is illustrated a ceramic bandpass filter 100 embodying the present invention. Filter 100 includes a block 130 which is comprised of a dielectric material that is selectively plated with a conductive material. Filter 100 can be constructed of any suitable dielectric material that has low loss, a high dielectric constant and a low temperature coefficient of the dielectric constant. In a preferred embodiment, filter 100 is comprised of a ceramic compound including barium oxide, titanium oxide and zirconium oxide, the electrical characteristics of which are described in more detail in an article by G. H. Jonker and W. Kwestroo, entitled "The Ternary Systems $BaO$-$TiO_2$-$SnO_2$ and $BaO$-$TiO_2$-$ZrO_2$", published in the Journal of the American Ceramic Society, volume 41, number 10, at pages 390–394, October 1958. Of the ceramic compounds described in this article, the compound in Table VI having the composition 18.5 mole % BaO, 77.0 mole % $TiO_2$ and 4.5 mole % $ZrO_2$ and having a dielectric constant of 40 is well suited for use in the ceramic filter of the present invention.

Referring to FIG. 1, block 130 of filter 100 is covered or plated with an electrically conductive material, such as copper or silver, with the exception of areas 140. Block 130 includes six holes 101–106, which each extend from the top surface to the bottom surface thereof. Holes 101–106 are likewise plated with an electrically conductive material. Each of the plated holes 101–106 is essentially a foreshortened coaxial resonator comprised of a short-circuited coaxial transmission line having a length selected for desired filter response characteristics.

Block 130 in FIG. 1 also includes input and output electrodes 124 and 125 and corresponding input and output connectors 120 and 122. Although block 130 is shown with six plated holes 101–106, any number of plated holes can be utilized depending on the filter response characteristics desired. For example, an embodiment of the ceramic bandpass filter of the present invention may include only one plated hole, an input electrode and an output electrode, as illustrated by filter 500 in FIG. 5. In addition, RF signals can be coupled to filter 500 by means of coaxial cables 520 and 522 in FIG. 5 instead of connectors 120 and 122 in FIG. 1.

Figure 2:
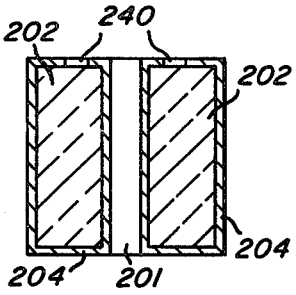
FIG. 2 is a cross section of the ceramic bandpass filter in FIG. 1 taken along lines 2—2.
Figure 3:
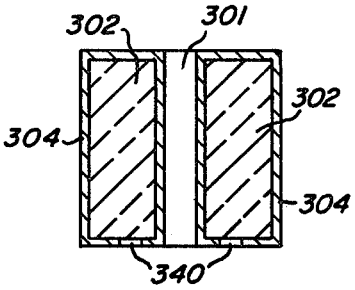
FIG. 3 is a cross section of another embodiment of the ceramic bandpass filter in FIG. 1 taken along lines 2—2.
Figure 4:
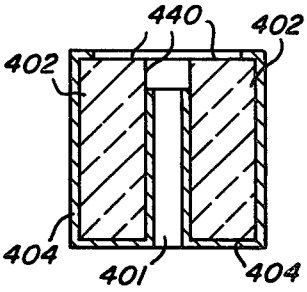
FIG. 4 is a cross section of a further embodiment of the ceramic bandpass filter in FIG. 1 taken along lines 2—2.

The plating of holes 101–106 in filter 100 in FIG. 1 is illustrated more clearly by the cross section in FIG. 2 which is taken along lines 2—2 in FIG. 1. Referring to FIG. 2, conductive plating 204 on dielectric material 202 extends through hole 201 to the top surface with the exception of a circular portion 240 around hole 201. Other conductive plating arrangements can be utilized, two of which are illustrated in FIGS. 3 and 4. In FIG. 3, conductive plating 304 on dielectric material 302 extends through hole 301 to the bottom surface with the exception of circular portion 340. The plating arrangement in FIG. 3 is substantially identical to that in FIG. 2, the difference being that unplated portion 340 is on the bottom surface instead of on the top surface. In FIG. 4, conductive plating 404 on dielectric material 402 extends partially through hole 401 leaving part of hole 401 unplated. The plating arrangement in FIG. 4 can also be reversed as in FIG. 3 so that the unplated portion 440 is on the bottom surface.

Figure 12:
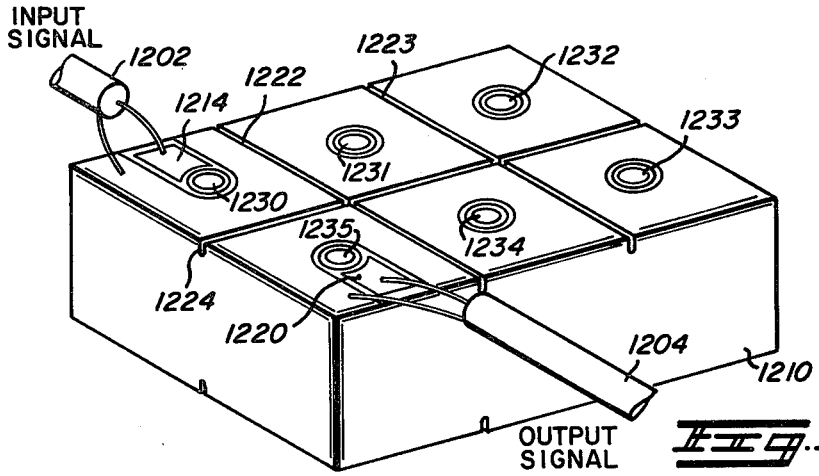
FIG. 12 illustrates yet another embodiment of the ceramic bandpass filter of the present invention.

Coupling between the coaxial resonators provided by plated holes 101–106 in FIG. 1 is accomplished through the dielectric material and is varied by varying the width of the dielectric material and the distance between adjacent coaxial resonators. The width of the dielectric material between adjacent holes 101–106 can be adjusted in any suitable regular or irregular manner, such as, for example, by the use of slots, cylindrical holes, square or rectangular holes, or irregular shaped holes. According to another feature of the present invention, filter 100 in FIG. 1 includes slots 110–114 for adjusting the coupling between coaxial resonators provided by holes 101–106. The amount of coupling is varied by varying the depth of the slots 110–114. Although slots 110–114 are shown on the side surfaces of filter 100 in FIG. 1, slots may also be disposed on the top and bottom surfaces as illustrated in FIG. 12. Futhermore, slots 110–114 can be disposed between adjacent plated holes on one surface, opposite surfaces or all surfaces. Slots 110–114 in FIG. 1 can be either plated or unplated depending on the amount of coupling desired.

Figure 11:
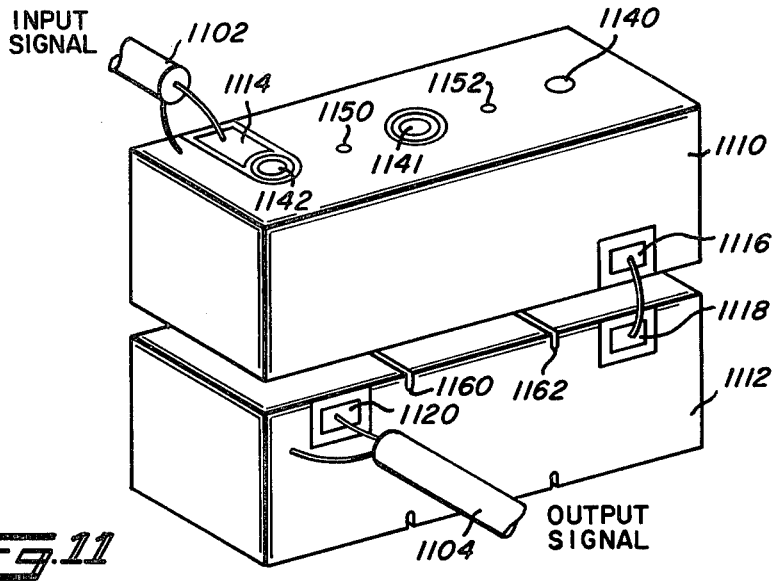
FIG. 11 illustrates another arrangement for cascading two ceramic bandpass filters of the present invention.

Furthermore, plated or unplated holes located between the coaxial resonators provided by holes 101–106 can also be utilized for adjusting the coupling. Similarly, such holes can be either plated or unplated and varied in size, location and orientation to obtain the desired coupling. In FIG. 11, holes 1150 and 1152 are utilized to adjust the coupling of filter 1110, and slots 1160 and 1162 are utilized to adjust the coupling of filter 1112. Holes 1150 and 1152 in filter 1110 in FIG. 11 may extend part or all of the way from the top surface to the bottom surface and may also be located on the side surface of filter 1110 instead of its top surface.

Figure 5:
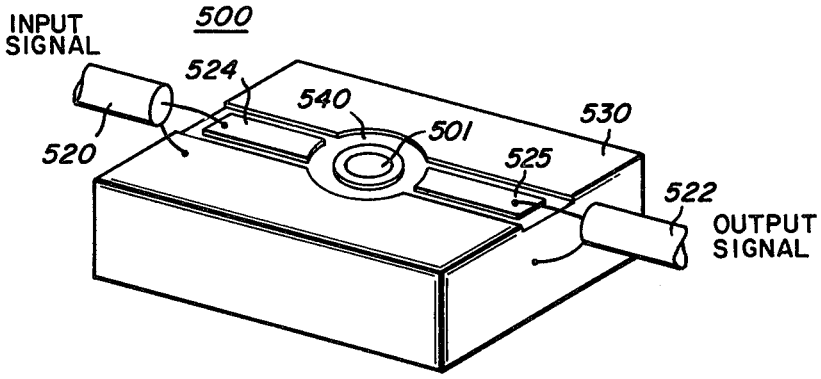
FIG. 5 is another embodiment of the ceramic bandpass filter of the present invention.

RF signals are capacitively coupled to and from filter 100 in FIG. 1 and filter 500 in FIG. 5 by means of input and output electrodes, 124, 125 and 524, 525, respectively. The resonant frequency of the coaxial resonators provided by plated holes 101–106 in FIG. 1 and plated hole 501 in FIG. 5 is determined primarily by the depth of the hole, thickness of the dielectric block in the direction of the hole and the amount of plating removed from the top of the filter near the hole. Tuning of filter 100 or 500 is accomplished by the removal of additional ground plating near the top of each plated hole. The removal of ground plating for tuning the filter can easily be automated, and can be accomplished by means of a laser, sandblast trimmer or other suitable trimming devices while monitoring the return loss angle of the filter. This tuning process is implemented by initially grounding the plating at the top of each plated hole 101–106 in FIG. 1 and measuring the return loss angle. Then, the ground to each plated hole is removed one at a time, and the ground plating near the top of that plated hole is trimmed until 180 degrees of phase shift is achieved. The grounding of each plated hole 101 to 106 can be done by means of a small plating runner that bridges the unplated area 140 between the plated hole and the surrounding plating on dielectric block 130.

Figure 6:
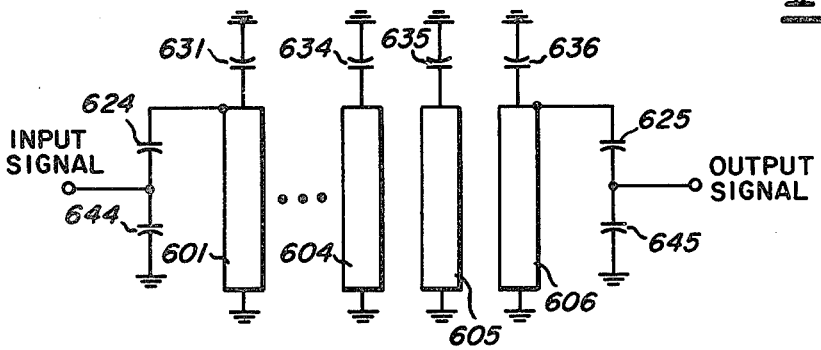
FIG. 6 is an equivalent circuit diagram for the ceramic bandpass filter in FIG. 1.

Referring to FIG. 6, there is illustrated an equivalent circuit diagram for the ceramic bandpass filter 100 in FIG. 1. An input signal from a signal source may be applied via connector 120 to input electrode 124 in FIG. 1, which corresponds to the common junction of capacitors 624 and 644 in FIG. 6. Capacitor 644 is the capacitance between electrode 124 and the surrounding ground plating, and capacitor 624 is the capcitance between electrode 124 and the coaxial resonator provided by plated hole 101 in FIG. 1. The coaxial resonators provided by plated holes 101–106 in FIG. 1 correspond to shorted transmission lines 601–606 in FIG. 6. Capacitors 631–636 in FIG. 6 represent the capacitance between the coaxial resonators provided by plated holes 101–106 in FIG. 1 and the surrounding ground plating on the top surface. Capacitor 625 represents the capacitance between the resonator provided by plated hole 106 and electrode 125 in FIG. 1, and capacitor 645 represents the capacitance between electrode 125 and the surrounding ground plating. An output signal is provided at the junction of capacitors 625 and 645, which corresponds to output electrode 125 in FIG. 1.

Figure 7:
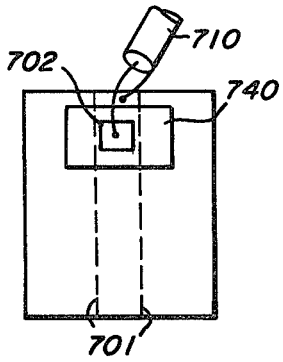
FIG. 7 illustrates an input signal coupling arrangement suitable for use in the ceramic bandpass filter of the present invention.
Figure 8:
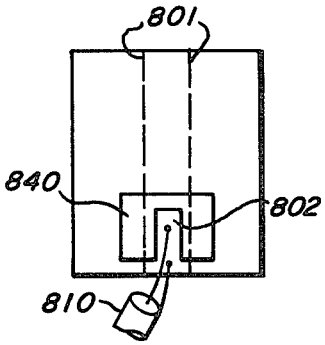
FIG. 8 illustrates another input signal coupling arrangement suitable for use in the ceramic bandpass filter of the present invention.
Figure 9:
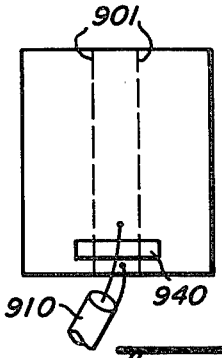
FIG. 9 illustrates yet another input signal coupling arrangement suitable for use in the ceramic bandpass filter of the present invention.

RF signals can be coupled to the ceramic bandpass filter of the present invention by capacitively coupling plated hole 101 or 106 by way of electrodes 124 or 125 in FIG. 1, or by the capacitive and inductive coupling arrangements shown in FIGS. 7, 8 and 9. In FIG. 7, electrode 702 surrounded by unplated area 740 is disposed on the side of the dielectric block opposite to the coaxial resonator provided by plated hole 701. An RF signal from coaxial cable 710 is applied to electrode 702 and capacitively coupled to the coaxial resonator provided by plated hole 701. In FIG. 8, a strip electrode 802 surrounded by unplated area 840 inductively couples an RF signal from coaxial cable 810 to the coaxial resonator provided by plated hole 801. The center conductor from coaxial cable 810 is attached to the tip of strip electrode 802 and the grounded shield of coaxial cable 810 is connected to the ground plating at the opposite end of strip electrode 802. In FIG. 9, the center conductor of coaxial cable 910 is connected to the ground plating above unplated area 940 and opposite the coaxial resonator provided by plated hole 901, and the grounded shield of coaxial cable 910 is connected to the ground plating below unshielded area 940 and also opposite the coaxial resonator provided by plated hole 901. Depending on the requirements of each application of the ceramic bandpass filter of the present invention, RF signals can be coupled to and from the inventive coaxial bandpass filter in any of the ways illustrated in FIGS. 1, 5, 7, 8 and 9. Moreover, if coupling of RF signals to the inventive ceramic bandpass filter is accomplished by means of electrodes as illustrated in FIGS. 1 and 5, the electrode can be oriented as illustrated in FIGS. 1 and 5 or can be located at any suitable position on the perifery of the corresponding plated hole. For example, an electrode can extend out to the end of the dielectric block as do electrodes 124 and 125 in FIG. 1, or to the side of the dielectric block as do electrodes 1014, 1016, 1018 and 1020 in FIG. 10.

Figure 10:
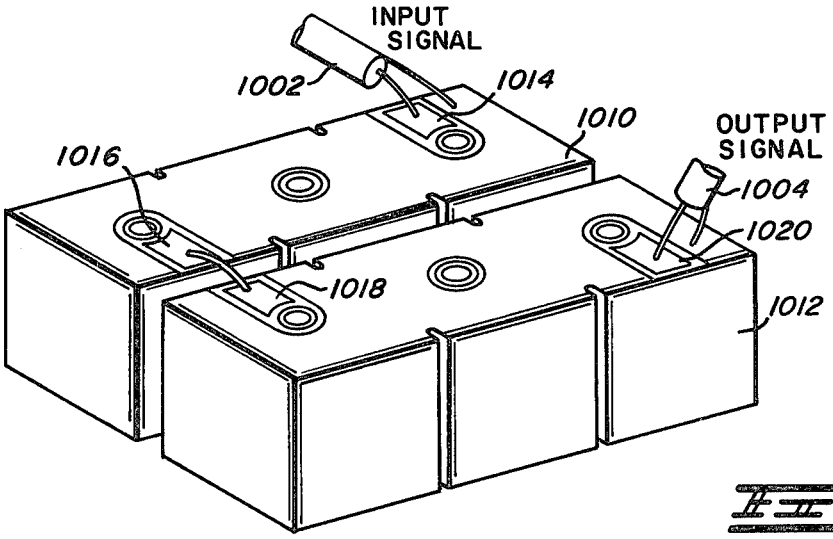
FIG. 10 illustrates one arrangement for cascading two ceramic bandpass filters of the present invention.

According to another feature of the present invention, two or more of the inventive ceramic bandpass filters can be cascaded to provide more selectivity, or can be intercoupled to provide a multi-band response characteristic. Two different cascade arrangements of the inventive ceramic bandpass filter are illustrated in FIGS. 10 and 11. In FIG. 10, filters 1010 and 1012 are arranged side by side. An input signal is coupled from coaxial cable 1002 to input electrode 1014 on filter 1010. Output electrode 1016 from filter 1010 is coupled to input electrode 1018 on filter 1012 by means of a short jumper wire. An output signal from output electrode 1020 on filter 1012 is connected to coaxial cable 1004. For ease of interconnection, electrodes 1016 and 1018 extend out to the sides of filters 1010 and 1012 instead of the end of the filter as do electrodes 124 and 125 in FIG. 1.

Referring to FIG. 11, filters 1110 and 1112 are arranged one on top of the other. An input signal from coaxial cable 1102 is connected to input electrode 1114 on filter 1010. Hole 1140 of filter 1010 is plated as illustrated in FIG. 3, such that the circular unplated portion around plated hole 1140 is on the bottom surface of filter 1010. Therefore, the output of filter 1010 can be capacitively coupled therefrom by means of output electrode 1116 in the same manner as illustrated and describe with respect to FIG. 7 hereinabove. The same type of capcitive coupling is provided by input electrode 1118 and output electrode 1120 in filter 1112. Accordingly, the output from filter 1110 is coupled from output electrode 1116 to input electrode 1118 of filter 1112 by means of a jumper wire. The output from filter 1112 provided at output electrode 1120 may be coupled to coaxial cable 1104.

According to yet another feature of the present invention, the coupling between the coaxial resonators provided by plated holes 1140–1142 in filter 1110 can be adjusted by means of additional holes 1150 and 1152, which are located between adjacent plated holes 1140–1142. The size, location, orientation and plating of additional holes 1150 and 1152 can be varied for varying the amount of coupling between adjacent coaxial resonators. For example, additional holes 1150 and 1152 can be parallel or perpendicular to plated holes 1140, 1141 and 1142. In filter 1112, the coupling has been adjusted by means of slots 1160 and 1162 located on the top and bottom surfaces between adjacent coaxial resonators. Furthermore, slots could also be provided on the side surfaces of filter 1112, such that slots are provided on all surfaces between adjacent resonators.

In FIG. 12 there is illustrated another embodiment of the ceramic bandpass filter of the present invention that includes six plated holes 1230–1236 arranged in two rows. The coaxial resonator provided by each plated hole in filter 1210 is coupled to two adjacent coaxial resonators, instead of one as illustrated by the filter in FIG. 1. Coupling from any one of the coaxial resonators to the two adjacent resonators can be individually adjusted by means of slots 1222, 1223 and 1224 provided therebetween. An input signal may be coupled by coaxial cable 1202 to input electrode 1214, and an output signal can be coupled to electrode 1220 by means of coaxial cable 1204. If the portion of slot 1224 between plated holes 1230 and 1235 and between plated holes 1231 and 1234 is deeper than slots 1222 and 1223, the input signal from coaxial cable 1202 may be coupled between plated holes 1230, 1231 and 1232, then across to plated hole 1233 and between plated holes 1233, 1234 and 1235 to coaxial cable 1204. A zig zag coupling path could be provided by making the slots between plated holes 1230 and 1231 and between plated holes 1234 and 1233 deeper and placing output electrode 1220 near hole 1233 instead of hole 1235. Also, input electrode 1214 and output electrode 1220 can be disposed on the end surface so that filter 1210 can be stood on end to conserve space.

According to yet a further of the present invention, coupling also occurs between plated holes 1230 and 1235 and between plated holes 1231 and 1234 in FIG. 12, and provides transmission zeros in the response characteristic of filter 1210. These transmission zeros make the skirt attenuation of filter 1210 steeper. As can be ascertained from filter 1210 in FIG. 12, the number and configuration of plated holes utilized in the ceramic bandpass filter of the present invention can be varied to achieve the response characteristics required for a particular application.

Figure 13:
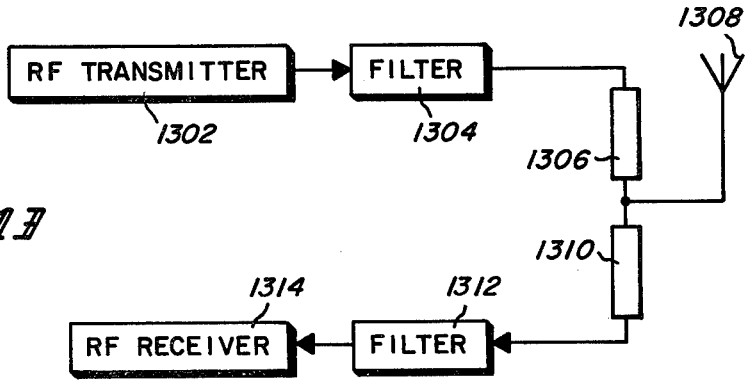
FIG. 13 illustrates a multi-band filter comprised of two ceramic bandpass filters of the present invention.

Referring to FIG. 13, there is illustrated a multiband filter comprised of two intercoupled ceramic bandpass filters 1304 and 1312 of the present invention. Two or more of the inventive ceramic bandpass filters can be intercoupled to provide apparatus that combines and/or frequency sorts two RF signals into and/or from a composite RF signal. For example, one application of this feature of the present invention is the arrangment in FIG. 13 which couples a transmit signal from an RF transmitter 1302 to an antenna 1308 and a receive signal from antenna 1308 to an RF receiver 1314. The arrangement in FIG. 13 can be advantageously utilized in mobile, portable and fixed station radios as an antenna duplexer. The transmit signal from RF transmitter 1302 is coupled to filter 1304 and thereafter by transmission line 1306 to antenna 1308. Filter 1304 is a ceramic bandpass filter of the present invention, such as the filter illustrated in FIGS. 1, 5, 10, 11 and 12. The passband of filter 1304 is centered about the frequency of the transmit signal from RF transmitter 1302, while at the same time greatly attenuating the frequency of the receive signal. In addition, the length of transmission line 1306 is selected to maximize its impedance at the frequency of the receive signal.

A receive signal from antenna 1308 in FIG. 13 is coupled by transmission line 1310 to filter 1312 and thereafter to RF receiver 1314. Filter 1312 which also may be one of the inventive ceramic bandpass filters illustrated in FIGS. 1, 5, 10, 11 and 12 has a passband centered about the frequency of the receive signal, while at the same time greatly attenuating the transmit signal. Similarly, the length of transmission line 1310 is selected to maximize its impedance at the transmit signal frequency for further attenuating the transmit signal.

In the embodiment of the RF signal duplexing apparatus in FIG. 13, transmit signals having a frequency range from 825 mHz to 845 mHz and receive signals having a frequency range from 870 mHz to 890 mHz were coupled to the antenna of a mobile radio. The ceramic bandpass filters 1304 and 1312 were of the type shown in FIG. 1. The filters 1304 and 1312 each had a length of 77.6 mm., a height of 11.54 mm. and a width of 11.74 mm. Filter 1304 had an insertion loss of 1.6 db and attenuated receive signals by at least 55 db. Filter 1312 had an insertion loss of 1.6 db and attenuated receive signals by at least 55 db.

In summary, an improved ceramic bandpass filter has been described that is more reliable and smaller than prior art filters. The construction of the ceramic bandpass filter of the present invention not only is simple but also amenable to automatic fabricating and adjusting techniques. The inventive ceramic bandpass filter can be cascaded with one or more other ceramic bandpass filters for providing greater selectivity, and can be intercoupled with one or more other ceramic bandpass filters to provide apparatus that combines and/or frequency sorts two or more RF signals into/from a composite RF signal. This feature of the present invention can be advantageously utilized for providing an antenna duplexer where a transmit signal is coupled to an antenna and a receive signal is coupled from the antenna.

We claim:

1. A filter comprising:

means comprised of a dielectric material having top and bottom surfaces, said dielectric means further having at least two holes extending from the top surface toward the bottom surface thereof and spatially disposed at a predetermined distance from one another;

first electrode means comprised of a conductive material disposed on the dielectric means at a predetermined distance from one of the holes in the dielectric means;

second electrode means comprised of a conductive material disposed on the dielectric means at a predetermined distance from a hole other than said one of the holes in the dielectric means; and said dielectric means further being covered with a conductive material with the exception of portions surrounding one end of said one hole and said other hole and surrounding the first and second electrode means, and the conductive material at said one end of each hole further being capacitively coupled to the surrounding conductive material whereby a foreshortened coaxial resonator is produced for each hole.

2. The filter according to claim 1, wherein the dielectric means is comprised of a block of a dielectric material having the shape of parallelepiped.

3. The filter according to claim 1, further including between said holes at least one additional hole for adjusting the electrical signal coupling from the first electrode means to the second electrode means.

4. The filter according to claim 1, or 2, further including a signal source for generating an input signal with respect to signal ground, the input signal being coupled to one of the first and second electrode means, and the conductive material covering the dielectric means being coupled to signal ground.

5. A filter comprising:

means comprised of a dielectric material having parallel, flat, top and bottom surface, said dielectric means having at least two holes extending from the top surface toward the bottom surface thereof and spatially disposed at a predetermined distance from one another;

first electrode means comprised of a conductive material plated on the top surface of the dielectric means at a predetermined distance from one of the holes in the dielectric means;

second electrode means comprised of a conductive material plated on the top surface of the dielectric means at a predetermined distance from a hole other than said one of the holes in the dielectric means; and said dielectric means further being plated entirely with a conductive material with the exception of portions surrounding one end of said one hole and said other hole and surrounding the first and second electrode means, and the conductive material at said one end of each hole further being capacitively coupled to the surrounding conductive material whereby a foreshortened coaxial resonator is produced for each hole.

6. The filter according to claim 5, wherein the dielectric means is comprised of a block of a dielectric material having the shape of parallelepiped.

7. The filter according to claim 5, further including between said holes at least one additional hole for adjusting the electrical signal coupling from the first electrode means to the second electrode means.

8. The filter according to claim 5, or 6, further including a signal source for generating an input signal with respect to signal ground, the input signal being coupled to one of the first and second electrode means, and the conductive material covering the dielectric means being coupled to signal ground.

9. A filter comprising:

means comprised of a dielectric material having a top surface, a bottom surface and first and second side surfaces, said dielectric means further having at least two holes extending from the top surface toward the bottom surface thereof and spatially disposed at a predetermined distance from one another;

first electrode means comprised of a conductive material disposed on one of the first and second side surfaces of the dielectric means at a predetermined distance from the top surface and substantially opposite one of the holes in the dielectric means;

second electrode means comprised of a conductive material disposed on one of the first and second side surfaces of the dielectric means at a predetermined distance from the top surface and substantially opposite a hole other than said one of the holes in the dielectric means; and said dielectric means further being entirely covered with a conductive material with the exception of portions surrounding one end of said one hole and said other hole and surrounding the first and second electrode means, and the conductive material at said one end of each hole further being capacitively coupled to the surrounding conductive material whereby a foreshortened coaxial resonator is produced for each hole.

10. A filter comprising:

means comprised of a dielectric material having top and bottom surfaces, said dielectric means further having at least three holes extending from the top surface toward the bottom surface thereof and spatially disposed at a predetermined distance from one another, each of said holes having a predetermined amount of electrical coupling to each other hole;

first electrode means comprised of a conductive material disposed on the dielectric means at a predetermined distance from one of the holes in the dielectric means; second electrode means comprised of a conductive material disposed on the dielectric means at a predetermined distance from a hole other than said one of the holes in the dielectric means; and said dielectric means further being entirely covered with a conductive material with the exception of portions surrounding one end of said one hole and said other hole and surrounding the first and second electrode means, and the conductive material at said one end of each hole further being capacitively coupled to the surrounding conductive material whereby a foreshortened coaxial resonator is produced for each hole.

11. A multi-band filter comprising:

(a) first filtering means comprising:

(i) means comprised of a dielectric material having top and bottom surfaces, said dielectric means further having at least two holes extending from the top surface toward the bottom surface thereof and spatially disposed at a predetermined distance from one another;

(ii) first electrode means comprised of a conductive material disposed on the dielectric means at a predetermined distance from one of the holes in the dielectric means;

(iii) second electrode means comprised of a conductive material disposed on the dielectric means at a predetermined distance from a hole other than said one of the holes in the dielectric means; and (iv) said dielectric means further being covered entirely with a conductive material with the exception of portions surrounding one end of said one hole and said other hole and surrounding the first and second electrode means, and the conductive material at said one end of each hole further being capacitively coupled to the surrounding conductive material whereby a foreshortened coaxial resonator is produced for each hole; and (b) second filtering means comprising:

(i) means comprised of a dielectric material having top and bottom surfaces, said dielectric means further having at least two holes extending from the top surface toward the bottom surface thereof and spatially disposed at a predetermined distance from one another;

(ii) first electrode means comprised of a conductive material disposed on the dielectric means at a predetermined distance from one of the holes in the dielectric means;

(iii) second electrode means comprised of a conductive material disposed on the dielectric means at a predetermined distance from a hole other than said one of the holes in the dielectric means; and (iv) said dielectric means further being covered entirely with a conductive material with the exception of portions surrounding one end of said one hole and said other hole and surrounding the first and second electrode means, and the conductive material at said one end of each hole further being capacitively coupled to the surrounding conductive material whereby a foreshortened coaxial resonator is produced for each hole; and (c) means for coupling the first electrode means of the first filtering means to the first electrode means of the second filtering means.

12. The multi-band filter according to claim 11, further including radio frequency (RF) transmitting means for generating a transmit signal, RF receiving means adapted to receive a receive signal, and means for radiating an RF signal; the transmit signal being coupled to the second electrode means of the first filtering means, the receive signal being coupled to the second electrode means of the second filtering means, and the radiating means being coupled to the first electrode means of the first filtering means and the first electrode means of the second filtering means.

13. The multi-band filter according to claim 12, further including first transmission line means interposed between the first electrode means of the first filtering means and the radiating means, said first transmission line means having a length such that its impedance is a maximum at the frequency of the receive signal; and further including second transmission line means interposed between the first electrode means of the second filtering means and the radiating means, said second transmission line means having a length such that its impedance is a maximum at the frequency of the transmit signal.

14. The multi-band filter according to claim 11, further including first radio frequency (RF) transmitting means for generating a first transmit signal, second RF transmitting means for generating a second transmit signal, and means for radiating an RF signal; the first transmit signal being coupled to the second electrode means of the first filtering means, the second transmit signal being coupled to the second electrode means of the second filtering means, and the radiating means being coupled to the first electrode means of the first filtering means and the first electrode means of the second bandpass filtering means.

15. The multi-band filter according to claim 14, further including first transmission line means interposed between the first electrode means of the first filtering means and the radiating means, said first transmission line means having a length such that its impedance is a maximum at the frequency of the receive signal; and further including second transmission line means interposed between the first electrode means of the second filtering means and the radiating mans, said second transmission line means having a length such that its impedance is a maximum at the frequency of the transmit signal.

16. The multi-band filter according to claim 11, further including first radio frequency (RF) receiving means adapted to receive a first receive signal, second RF receiving means adapted to receive a second receive signal, and means for radiating an RF signal; the first receive signal being coupled to the second electrode means of the first filtering means, the second receive signal being coupled to the second electrode means of the second filtering means, and the radiating means being coupled to the first electrode means of the first filtering means and the first electrode means of the second filtering means.

17. The multi-band filter according to claim 16, further including first transmission line means interposed between the first electrode means of the first filtering means and the radiating means, said first transmission line means having a length such that its impedance is a maximum at the frequency of the receive signal; and further including second transmission line means interposed between the first electrode means of the second filtering means and the radiating means, said second transmission line means having a length such that its impedance is a maximum at the frequency of the transmit signal.

18. A filter comprising:

means comprised of a dielectric material having top and bottom surfaces, said dielectric means further having at least two holes extending from the top surface toward the bottom surface thereof and spatially disposed at a predetermined distance from one another;

first electrode means comprised of a conductive material disposed at a predetermined distance from one of the holes in the dielectric means;

second electrode means comprised of a conductive material disposed at a predetermined distance from a hole other than said one of the holes in the dielectric means; and said dielectric means further being covered with a conductive material with the exception of portions surrounding one end of said one hole and said other hole, and surrounding the first and second electrode means, and the conductive material at said one end of each hole further being capacitively coupled to the surrounding conductive material whereby a foreshortened coaxial resonator is produced for each hole.

19. The filter according to claim 18, wherein the dielectric means is comprised of a block of a dielectric material having the shape of parallelpiped.

20. The filter according to claim 18, further including between said holes at least one additional hole for adjusting the electrical signal coupling from the first electrode means to the second electrode means.

21. The filter according to claim 18, further including a signal source for generating an input signal with respect to signal ground, the input signal being coupled to one of the first and second electrode means, and the conductive material covering the dielectric means being coupled to signal ground.

22. A filter comprising:

means comprised of a dielectric material having first and second surfaces, said dielectric means further having at least two holes extending from the first surface toward the second surface thereof and spatially disposed at a predetermined distance from one another;

first coupling means associated with one of the holes in the dielectric means;

second coupling means associated with a hole other than said one of the holes in the dielectric means; and said dielectric means further being covered with a conductive material with the exception of portions surrounding one end of said one hole and said other hole, and surrounding the first and second electrode means, and the conductive material at said one end of each hole further being capacitively coupled to the surrounding conductive material whereby a foreshortened coaxial resonator is produced for each hole.

23. The filter according to claim 22, wherein the dielectric means is comprised of a block of dielectric material having the shape of parallelpiped.

24. The filter according to claim 22, further including between said holes at least one additional hole for adjusting the electrical signal coupling from the first coupling means to the second coupling means.

25. The filter according to claim 22, further including a signal source for generating an input signal with respect to signal ground, the input signal being coupled to one of the first and second coupling means, and the conductive material covering the dielectric means being coupled to signal ground.

26. A filter comprising:

a block comprised of a dielectric material having first and second surfaces, said dielectric block further having at least two holes extending from the first surface toward the second surface thereof and spatially disposed at a predetermined distance from one another;

a first electrode associated with one of the holes in the dielectric block;

a second electrode associated with a hole other than said one of the holes in the dielectric block; and said dielectric block further being covered with a conductive material with the exception of portions surrounding one end of said one hole and said other hole, and surrounding the first and second electrode means, and the conductive material at said one end of each hole further being capacitively coupled to the surrounding conductive material whereby a foreshortened coaxial resonator is produced for each hole.

27. A filter comprising:

means comprised of a dielectric material having top and bottom surfaces, said dielectric means further having at least two holes extending from the top surface toward the bottom surface thereof and spatially disposed at a predetermined distance from one another;

first electrode means comprised of a conductive material disposed on the dielectric means at a predetermined distance from one of the holes in the dielectric means;

second electrode means comprised of a conductive material disposed on the dielectric means at a predetermined distance from a hole other than said one of the holes in the dielectric means; and said dielectric means further including at least one slot between said one hole and said other hole for adjusting the electrical signal coupling from the first electrode means to the second electrode means, and said dielectric means further being covered with a conductive material with the exception of portions near the slot, near one end of said one hole and said other hole and near the first and second electrode means.

28. The filter according to claim 27, wherein said slots are covered with a conductive material.

29. The filter according to claim 27, wherein said dielectric means has two end surfaces and two side surfaces, and said slots are disposed on at least one of the top, bottom and side surfaces.

30. The filter according to claim 29, wherein said slots are disposed on at least two opposite surfaces.

31. A filter comprising:

means comprised of a dielectric material having parallel, flat, top and bottom surfaces, said dielectric means further having at least two holes extending from the top surface toward the bottom surface thereof and spatially disposed at a predetermined distance from one another;

first electrode means comprised of a conductive material plated on the top surface of the dielectric means at a predetermined distance from one of the holes in the dielectric means;

second electrode means comprised of a conductive material plated on the top surface of the dielectric means at a predetermined distance from a hole other than said one of the holes in the dielectric means;

and said dielectric means further including at least one slot between said one hole and said other hole for adjusting the electrical signal coupling from the first electrode means to the second electrode means, and said dielectric means further being plated with a conductive material with the exception of portions near the slot, near one end of said one hole and said other hole and near the first and second electrode means.

32. The filter according to claim 31, wherein said slots are plated with a conductive material.

33. The filter according to claim 31, wherein said dielectric means has two end surfaces and two side surfaces, and said slots are disposed on at least one of the top, bottom and side surfaces.

34. The filter according to claim 33, wherein said slots are disposed on at least two opposite surfaces.

35. A filter comprising:

means comprised of a dielectric material having top and bottom surfaces, said dielectric means further having at least two holes extending from the top surface toward the bottom surface thereof and spatially disposed at a predetermined distance from one another;

first electrode means comprised of a conductive material disposed at a predetermined distance from one of the holes in the dielectric means;

second electrode means comprised of a conductive material disposed at a predetermined distance from a hole other than said one of the holes in the dielectric means; and said dielectric means further including at least one slot between said one hole and said other hole for adjusting the electrical signal from the first electrode means to the second electrode means, and said dielectric means further being covered with a conductive material with the exception of portions near the slot and near one end of said one hole and said outer hole.

36. The filter according to claim 35, wherein said slots are covered with a conductive material.

37. The filter according to claim 35, wherein said dielectric means has two end surfaces and two side surfaces, and said slots are disposed on at least one of the top, bottom and side surfaces.

38. The filter according to claim 39, wherein said slots are disposed on at least two opposite surfaces.

39. A filter comprising:

means comprised of a dielectric material having first and second surfaces, said dielectric means further having at least two holes extending from the first surface toward the second surface thereof and spatially disposed at a predetermined distance from one another;

first coupling means associated with one of the holes in the dielectric means;

second coupling means associated with a hole other than said one of the holes in the dielectric means; and said dielectric means further including at least one slot between said one hole and said other hole for adjusting the electrical signal coupling from the first coupling means to the second coupling means, and said dielectric means further being entirely covered with a conductive material with the exception of portions near the slot and near one end of said one hole and said other hole.

40. The filter according to claim 39, wherein said slots are covered with a conductive material.

41. The filter according to claim 39, wherein said dielectric means has two end surfaces and two side surfaces, and said slots are disposed on at least one of the top, bottom and side surfaces.

42. The filter according to claim 41, wherein said slots are disposed on at least two opposite surfaces.

43. A method of adjusting the resonant frequency of a filter including means comprised of a dielectric material having first and second surfaces, said dielectric means further having at least two holes extending from the first surface toward the second surface thereof and spatially disposed at a predetermined distance from one another, first coupling means associated with one of the holes in the dielectric means, and second coupling means associated with a hole other than said one of the holes in the dielectric means, said method comprising the steps of:

(a) covering the dielectric means with a conductive material with the exception of a first portion surrounding one end of said one hole and a second portion surrounding one end of said other hole;

(b) covering part of said first portion and part of said second portion to produce a first electrode and a second electrode, respectively; and (c) removing a portion of the conductive material surrounding said one end of said one hole and said one end of said other hole to produce a pre-selected resonant frequency of said filter.

44. A method of adjusting the frequency response and resonant frequency of a filter including means comprised of a dielectric material having first and second surfaces, said dielectric means further having at least two holes extending from the first surface toward the second surface thereof and spatially disposed at a predetermined distance from one another, first coupling means associated with one of the holes in the dielectric means, and second coupling means associated with a hole other than said one of the holes in the dielectric means, said method comprising the steps of:

(a) covering the dielectric means with a conductive material with the exception of a first portion surrounding one end of said one hole and a second portion surrounding one end of said other hole;

(b) covering part of said first portion and part of said second portion to produce a first electrode and a second electrode, respectively;

(c) removing a portion of the conductive material from the surface of the dielectric means between said one hole and said other hole to adjust the frequency response of said filter; and (d) removing a portion of the conductive material surrounding said one end of said one hole and said one end of said other hole to produce a pre-selected resonant frequency of said filter.

45. A method of adjusting the frequency response and resonant frequency of a filter including means comprised of a dielectric material having first and second surfaces, said dielectric means further having at least two holes extending from the first surface toward the second surface thereof and spatially disposed at a predetermined distance from one another, first coupling means associated with one of the holes in the dielectric means, and second coupling means associated with a hole other than said one of the holes in the dielectric means, said method comprising the steps of:

(a) covering the dielectric means with a conductive material with the exception of a first portion surrounding one end of said one hole and a second portion surrounding one end of said other hole;

(b) covering part of said first portion and part of said second portion to produce a first electrode and a second electrode, respectively;

(c) removing a portion of the dielectric means between said one hole and said other hole to adjust the frequency response of said filter; and (d) removing a portion of the conductive material surrounding said one end of said one hole and said one end of said other hole to produce a pre-selected resonant frequency of said filter.

46. The method according to claim 45, wherein said step (c) includes the step of producing at least one slot in the dielectric means between said one hole and said other hole.

47. The method according to claim 45, wherein said step (c) includes the step of producing at least one additional hole in the dielectric means between said one hole and said other hole.

48. A filter comprising:

means comprised of a dielectric material having top and bottom surfaces, said dielectric means further having at least two holes extending from the top surface toward the bottom surface thereof and spatially disposed at a predetermined distance from one another;

first electrode means comprised of a conductive material disposed on the dielectric means at a predetermined distance from one of the holes in the dielectric means;

second electrode means comprised of a conductive material disposed on the dielectric means at a predetermined distance from a hole other than said one of the holes in the dielectric means; and said dielectric means further being covered with a conductive material with the exception of portions surrounding one end of said one hole and said other hole and surrounding the first and second electrode means, and the conductive material at said one end of each hole further being overlapped on the surface of the dielectric means and capacitively coupled to the surrounding conductive material whereby a foreshortened coaxial resonator is produced for each hole.

* * * * *

UNITED STATES PATENT AND TRADEMARK OFFICE

CERTIFICATE OF CORRECTION

PATENT NO. : 4,431,977

DATED : February 14, 1984

INVENTOR(S) : Raymond L. Sokola and Charles Choi

It is certified that error appears in the above—identified patent and that said Letters Patent is hereby corrected as shown below:

In column 7, line 60, delete "surface" and insert --surfaces--.

In column 10, line 38, delete "bandpass".

In column 13, line 48, delete "outer" and insert --other--.

Signed and Sealed this

*Eighteenth* Day of *September 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,431,977

DATED : February 14, 1984

INVENTOR(S) : SOKOLA, et al.

It is certified that error appears in the above-identified patent and that said Letters Patent is hereby corrected as shown below:

In Column 13, line 55, delete "39" and insert --37--.

Signed and Sealed this

*Twenty-sixth* Day of *March 1985*

[SEAL]

*Attest:*

DONALD J. QUIGG

*Attesting Officer*

*Acting Commissioner of Patents and Trademarks*